US006375432B1

(12) United States Patent
Krasny et al.

(10) Patent No.: US 6,375,432 B1
(45) Date of Patent: Apr. 23, 2002

(54) PIPELINE AIR POCKET DETECTION SYSTEM

(75) Inventors: Alexander Krasny, Eagan; Thomas M. Anderson, Hugo, both of MN (US)

(73) Assignee: Schwing America, Inc., White Bear, MN (US)

( * ) Notice: Subject to any disclaimer, the term of this patent is extended or adjusted under 35 U.S.C. 154(b) by 0 days.

(21) Appl. No.: 09/745,121

(22) Filed: Dec. 20, 2000

(51) Int. Cl.[7] ..... F04B 49/00; F04B 19/24; F04B 15/02; F04B 35/00

(52) U.S. Cl. ..... 417/46; 417/63; 417/53; 417/403; 417/900

(58) Field of Search ..... 417/63, 53, 900, 417/46, 403

(56) References Cited

U.S. PATENT DOCUMENTS

| | | | | |
|---|---|---|---|---|
| 2,854,170 A | * | 9/1958 | Borgardt et al. | 222/1 |
| 5,106,272 A | | 4/1992 | Oakley et al. | 417/347 |
| 5,257,912 A | | 11/1993 | Oakley et al. | 417/63 |
| 5,332,366 A | | 7/1994 | Anderson | 417/63 |
| 5,336,055 A | | 8/1994 | Anderson | 417/317 |
| 5,346,368 A | | 9/1994 | Oakley et al. | 417/63 |
| 5,353,684 A | | 10/1994 | Schwing | 91/446 |
| 5,359,516 A | | 10/1994 | Anderson | 364/424.07 |
| 5,388,965 A | | 2/1995 | Fehn | 417/63 |
| 5,401,140 A | | 3/1995 | Anderson | 417/63 |
| 5,507,624 A | * | 4/1996 | Fehn | 417/53 |
| 5,520,521 A | * | 5/1996 | Benckert et al. | 417/280 |
| 5,557,526 A | | 9/1996 | Anderson | 364/424.07 |
| RE35,473 E | | 3/1997 | Oakley et al. | 417/347 |
| 5,823,747 A | * | 10/1998 | Ciavarini et al. | 417/216 |
| 5,839,883 A | | 11/1998 | Schmidt et al. | 417/63 |
| 6,202,013 B1 | | 3/2001 | Anderson et al. | 701/50 |

FOREIGN PATENT DOCUMENTS

| | | | | |
|---|---|---|---|---|
| CA | 967427 | * | 5/1975 | 103/6 |

* cited by examiner

*Primary Examiner*—Timothy S. Thorpe
*Assistant Examiner*—Timothy P. Solak
(74) *Attorney, Agent, or Firm*—Kinney & Lange

(57) ABSTRACT

A method of detecting an air pocket in a concrete pump and minimizing the effect of the nozzle and boom reaction as the air pocket reaches the end of the boom. The hydraulic pressure of the pump is monitored to determine when a pump stroke contains air. Upon detection of air in a pump stroke, an alarm is sounded and the pump is slowed to minimize the effect of the air pocket when it reaches the nozzle of the boom.

24 Claims, 5 Drawing Sheets

PIPELINE AIR POCKET DETECTION SYSTEM

CROSS-REFERENCE TO RELATED APPLICATION(S)

None.

BACKGROUND OF THE INVENTION

The present invention relates to a concrete pump, and more particularly, to a system for detecting when air enters a concrete pump boom during a pumping stroke and controlling the operation of the concrete pump to minimize the effect of the air when it exits the boom.

Truck mounted concrete pumps are large concrete pumps carried on the frame of the truck. Truck mounted concrete pumps are used in a variety of large construction projects, including bridges, parking ramps, skyscrapers, and other types of multistory buildings. The concrete pumps comprise a hopper for receiving the concrete from a concrete supply source, such as a ready mix truck. From the hopper, the concrete is pumped through a boom system to a nozzle where the concrete exits the boom system. The boom system allows concrete to be delivered at significant distances from the hopper.

On the construction site, the operation of a truck mounted concrete pump typically involves several operators. A first operator monitors the supply of concrete from the ready mix truck to the hopper, a second operator controls the boom location and pump speed, and a third operator is positioned at the nozzle to control the application of the concrete. The first operator's main responsibility is to ensure the hopper maintains a desired level of concrete. The first operator does this by controlling the speed at which concrete is fed from the ready mix truck into the hopper. For the pump to operate optimally, the concrete level in the hopper must be high enough to ensure that with each pumping stroke, the pump completely fills with concrete.

Should the operator become distracted, it is possible for the concrete level in the hopper to get too low, allowing a mixture of air and concrete to enter the pump. Once air enters the pump, an air pocket forms in the boom. Concrete is a nearly incompressible and highly viscous liquid so that as concrete continues to be pumped, the air pocket becomes compressed between the concrete entering the boom behind the air pocket and the concrete already in the boom ahead of the air pocket.

This compressed air pocket adversely affects the operation of the concrete pump. When the compressed air reaches the nozzle, it rapidly expands to atmospheric pressure, causing any concrete immediately in front of the air pocket to explode from the nozzle. This explosive spray of concrete not only splatters the concrete previously applied by the nozzle, but also causes the nozzle and boom to bounce and move around unpredictably and dangerously. If the operator located at the nozzle is unaware of the presence of the air pocket the operator may be knocked off balance by the movement of the boom. Any other personnel located near the nozzle must likewise use caution due to the unpredictable movement of the boom and uncontrolled burst of concrete from the nozzle.

In an effort to prevent the entrance of air into the boom, some contractors position two operators near the hopper to ensure the correct level of concrete remains in the hopper at all times. However, this greatly increases the cost associated with operating a concrete pump. Thus, there is a need in the art for a system to notify an operator that an air pocket is approaching in the boom pipeline, and there is a further need to minimize the explosive affect as the air pocket exits the boom.

BRIEF SUMMARY OF THE INVENTION

The present invention provides a method of detecting the introduction of air into a concrete pumping system and further comprises a method of minimizing the nozzle and boom reaction when the air exits at the nozzle. The hydraulic pressure of the concrete pump is monitored to determine when a pump stroke contains air. As soon as air enters the boom system, an alarm notifies the operators of the pump that an air pocket is present in the boom. In addition, to minimize the effect the air pocket will have at the nozzle, the pump is controlled to slow the number of pumping strokes per minute as the air pocket approaches the exit of the concrete pump. By slowing the pump, the explosive effect created when the air pocket exits the boom is greatly minimized.

DETAILED DESCRIPTION

Figure 1:
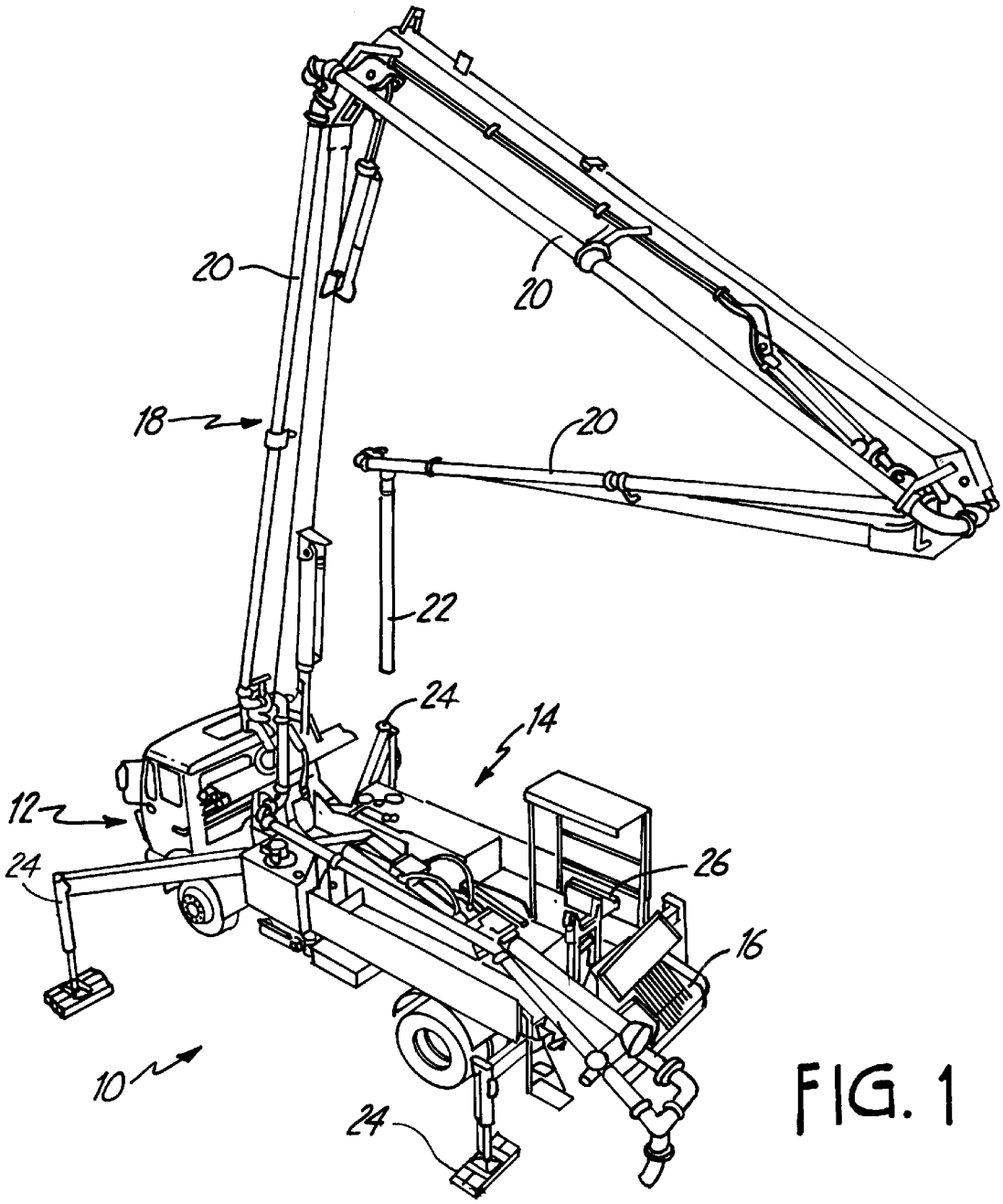
FIG. 1 is a perspective view of a truck mounted concrete pump.

FIG. 1 is a perspective view of a truck mounted concrete pump 10. The truck mounted concrete pump 10 comprises a cab 12 on the front of the truck 10 and a pump 14 mounted on the rear of the truck 10. Also on the rear of the truck 10 is a hopper 16 through which concrete enters the pump 14, and a boom system 18 comprising several lengths of boom 20 and ending in a nozzle 22. Several stabilizers 24 are provided on the rear of the truck 10 which can be extended once the truck 10 is positioned at the desired location. A set of pump controls 26 is located near the hopper 16 on the back of the truck 10.

When operating the pump 14, there are typically three operators. First, an operator is positioned at the hopper 16 to monitor the supply of concrete into the pump 14. Typically, concrete is supplied to the pump 14 by unloading concrete from a ready-mix truck or similar concrete supply mechanism. A second operator controls the placement of the boom system 18 and controls the pump speed. The second operator may be located at either the pump controls 26 or may have a set of remote controls allowing the operator to be located away from the truck 10. Finally, a third operator is positioned at the end of the boom system 18 at nozzle 22. The third operator controls the placement of concrete as it is ejected from the nozzle 22.

As the pump 14 is operating, the operator positioned at the hopper 16 must constantly monitor the flow of concrete into the hopper 16 to ensure the desired level of concrete exists in the hopper 16 at all times. Should the hopper 16 become too full, the first operator must slow the feed of concrete from the ready-mix truck to prevent the hopper 16 from overflowing. In addition, the operator must likewise prevent the hopper 16 from becoming too depleted at any given time. If the level of concrete in the hopper 16 becomes too low, it is possible for air to enter the pump 14. Once air has entered the pump 14, an air pocket is created which is forced through the boom 20 until it reaches the nozzle 22.

The air pocket in the boom 20 is compressed as concrete continues to be pumped into the boom 20. Concrete is essentially a non-compressible fluid. Thus, the concrete already in the boom 20 above the air pocket is not compressible, nor is the concrete pumped into the boom 20 behind the air pocket. Unlike the concrete, the air is compressible so that as concrete continues to be pumped through the boom system 18, the air pocket in the boom 20 is compressed between the concrete above the air pocket and the concrete pumped into the boom 20 behind the air pocket.

As the air pocket reaches the nozzle 22, it rapidly expands to atmospheric pressure. This rapid expansion is akin to a small explosion with a small amount of concrete being ejected from the nozzle 22 at a very high speed, splattering the concrete already poured below the nozzle 22. In addition, the explosive effect can cause the nozzle 22 and boom 20 to swing around unpredictably, sometimes even knocking the operator at the nozzle 22 off balance. This movement of the nozzle 22 can likewise affect any workers located near the nozzle 22.

The present invention is a method for determining when air is allowed to enter the pump. Once it is discovered that an air pocket has entered the pump, an alarm notifies the operators of this fact, including the first operator at the hopper 16, the second operator controlling the position of the boom system 18 and pump speed, as well as the operator located at the nozzle 22. Once so notified, it is possible for the first operator at the hopper 16 to recognize the need for increased vigilance of the concrete supply source to ensure the proper level of concrete is being fed into the hopper 16. The second operator can control the speed of the pump to lessen the impact of the air pocket as it approaches the nozzle 22. Finally, the operator located at the nozzle 22 is prepared for the explosive effect of the air pocket as it exits the nozzle 22 and can take steps to prevent the concrete from splattering and can attempt to keep the boom 20 and nozzle 22 under control.

Figure 2:
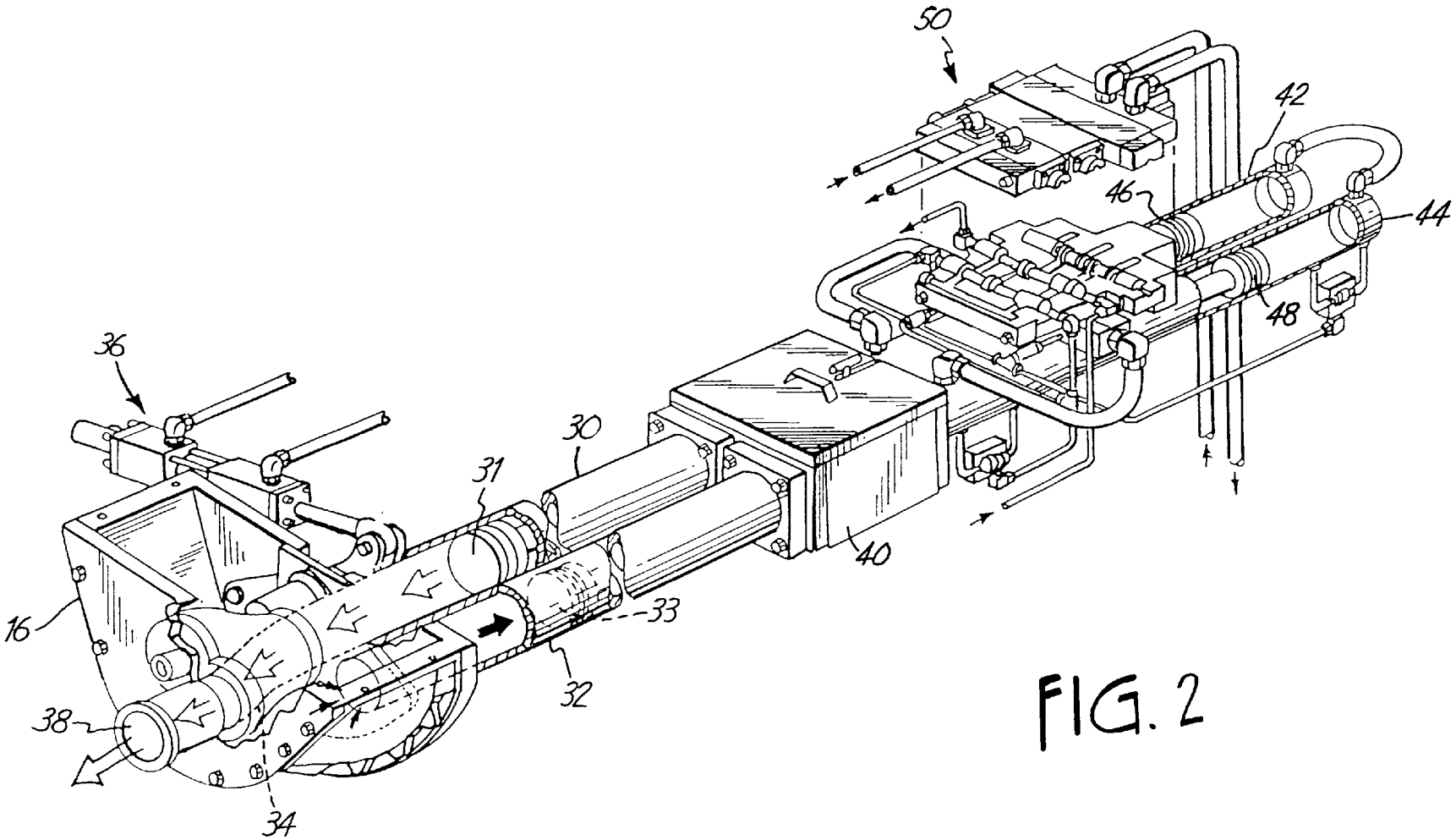
FIG. 2 is a perspective view the outlet valve and pumping cylinders of the truck mounted concrete pump.

FIG. 2 is a perspective view of a portion of one type of concrete pump which makes use of the present invention. The pump includes a hopper 16, material cylinders 30, 32, material pistons 31, 33 located in the material cylinders 30, 32, an outlet valve 34 also called a Rock™ valve 34, a Rock valve hydraulic system 36, and a concrete outlet 38. Behind the material cylinders 30, 32 is a water box 40, two hydraulic drive cylinders 42, 44, hydraulic pistons 46, 48 located in the hydraulic drive cylinders 42, 44, and a hydraulic valve assembly 50. The hydraulic pistons 46, 48 are connected to the material pistons 31, 33 so that as one hydraulic piston 46 is actuated by hydraulic pressure and moves forward in the hydraulic cylinder 42, the associated material piston 31 is actuated in a similar fashion and moves forward in its material cylinder 30.

The hydraulic cylinders 42, 44 operate in an alternating, reciprocating fashion so that as one hydraulic piston 46 extends, the other hydraulic piston 48 retracts. More specifically, as one hydraulic piston 48 retracts, the material piston 33 associated with that hydraulic piston 48 likewise retracts, sucking concrete from the hopper 16 into its material cylinder 32 (the suction stroke). At the same time, the other hydraulic piston 46 extends, causing the material piston 31 to likewise extend, pumping the concrete located in the material cylinder 30 out through the outlet 38 (the pump stroke). Thus while one material piston 33 is retracting and filling the associated material cylinder 32 with concrete, the other material piston 31 is advancing to push concrete out of the other cylinder 30 through the outlet 38. This reciprocating pumping action is well known in the art of concrete pumps.

To allow for material to be pushed through the outlet 38 at the same time material is being drawn in from the hopper 16, the pump has a pivoting output Rock valve 34. The Rock valve 34 is located in the hopper 16 and alternately connects the outlet 38 with one of the two material cylinders 30, 32. At the same time, the Rock valve 34 also allows the inlet to the other material cylinder 30, 32 to be exposed to the interior of the hopper 16. As viewed in FIG. 2, the Rock valve 34 is positioned so that the concrete in cylinder 30 is being forced from the cylinder 30 through the outlet 38 by the material piston 31. While in this same position, the Rock valve 34g allows concrete to enter the other cylinder 32 from the hopper 16. At the end of each pumping stroke the hydraulic pistons 46, 48 reach an end of their hydraulic cylinders 42, 44, and reverse direction. The Rock valve 34 likewise changes position.

After changing position, the Rock valve 34 connects the second cylinder 32 to the outlet 38 so that concrete in the now filled cylinder 32 can be forced out of the cylinder 32 through the outlet 38. At the same time, the first cylinder 30 is exposed to the hopper 16 so that as the material piston 31 recedes, the first cylinder 30 now fills with concrete. In this manner, concrete can be pumped nearly continuously through the pump.

It is possible to monitor the hydraulic pressure supplied to the hydraulic cylinders 42, 44 on the pump stroke. In so monitoring the hydraulic pressure, it is possible to detect when air has entered the pump. The hydraulic pressure exhibited by a pump stroke pumping only concrete differs from the hydraulic pressure exhibited by a pump stroke pumping a mix of concrete and air. During a pump stroke that is pumping only concrete, the hydraulic pressure remains relatively constant and high for the duration of the stroke. During a stroke that is pumping a mixture of both concrete and air, the hydraulic pressure starts relatively low and increases greatly as the air is compressed. These characteristics can be used to detect instances when air has entered the pump.

Figure 3:
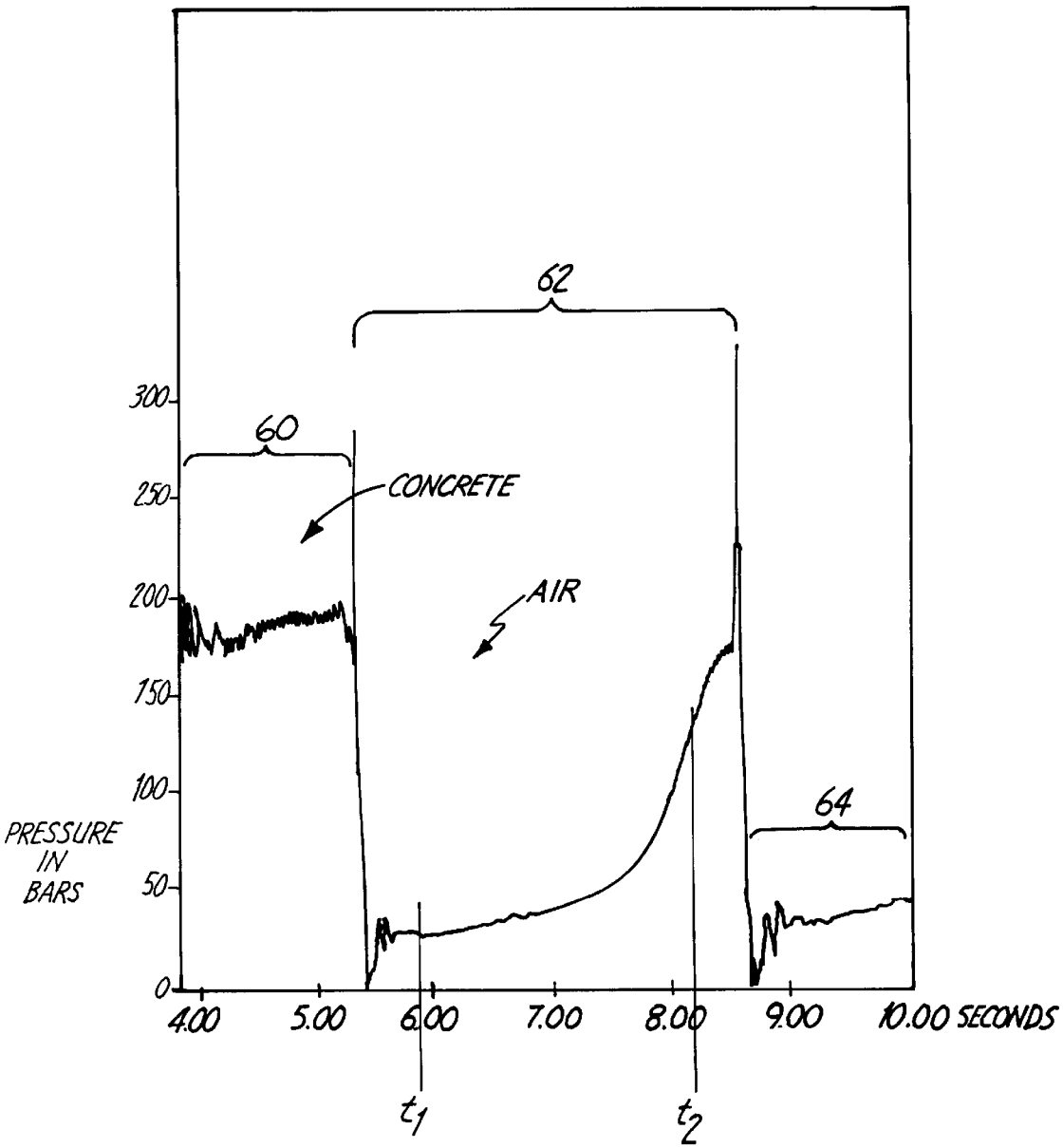
FIG. 3 is a graphical illustration of the pressure experienced during a pumping stroke of the concrete pump.

FIG. 3 is a graphical depiction of the hydraulic pressure experienced by plotting the time in seconds against the pressure in bars. Three strokes are 60, 62, 64, are depicted in FIG. 3. In the first stroke 60, the pressure remains relatively constant for the duration of the stroke. This relatively constant pressure indicates a pump stroke containing all concrete with no air. In the second stroke 62, the pressure experiences a significant pressure curve over the duration of the stroke. This change in pressure indicates the pump stroke contains air in addition to concrete. Initially, the hydraulic pressure remains low during the time it takes to compress the air. Once the air is compressed, the hydraulic pressure varies along the pressure curve, moving from low pressure to a much higher pressure as the concrete and air begin to be pushed forward. The third stroke 64 once again shows a relatively constant pressure throughout the duration of the stroke, and once again indicates a pump stroke containing all concrete and no air.

One way to monitor the hydraulic pressure during the pumping strokes is to begin by determining the start of each pump stroke. As described above, a pump stroke refers to the action of one of the material pistons 31, 33 moving forward in the material cylinders 30, 32 to push the concrete out of the cylinder 30, 32, through the outlet 38, and into the boom 20. The Rock valve 34 changes position each time a new pump stroke starts, therefore one suitable method of determining when a stroke begins is to simply install a proximity sensor on the Rock valve hydraulic system 36 to sense when the Rock valve 34 changes position. It may also be possible to determine the start of a pump stroke by monitoring the hydraulic pressure of the pump. In addition, any other method of sensing or determining the beginning of a stroke is likewise suitable for use in the present invention.

Once the beginning of a stroke has been determined, the hydraulic pressure is monitored during the stroke. If the hydraulic pressure remains relatively constant, the stroke is classified as a "concrete" stroke. If the hydraulic pressure experiences a curve, the stroke is classified as a "non-concrete" stroke. Once a stroke has been classified as a non-concrete stroke, the operators are alerted to this fact. One method of alerting the operators is to sound a loud horn. Other methods of alerting the operators would likewise be suitable, such as a flashing light or a series of audible beeps.

In addition to notifying the operators that the pump has taken in air, it is possible to control the pump to minimize the effects of the air pocket once it reaches the nozzle. The pump can be slowed so that when the air pocket reaches the nozzle, its explosive effect is lessened. The pump may be slowed immediately upon sensing the air pocket, or the pump can be slowed just before the air pocket exits the nozzle. The air pocket must travel through the length of the boom before it reaches the nozzle, which depending on the length of the boom, may take several pumping strokes. To ensure the maximum efficiency of the pump, the strokes can be counted after the air pocket is sensed, so that the pump is slowed only when the air pocket has almost reached the nozzle.

Figure 4:
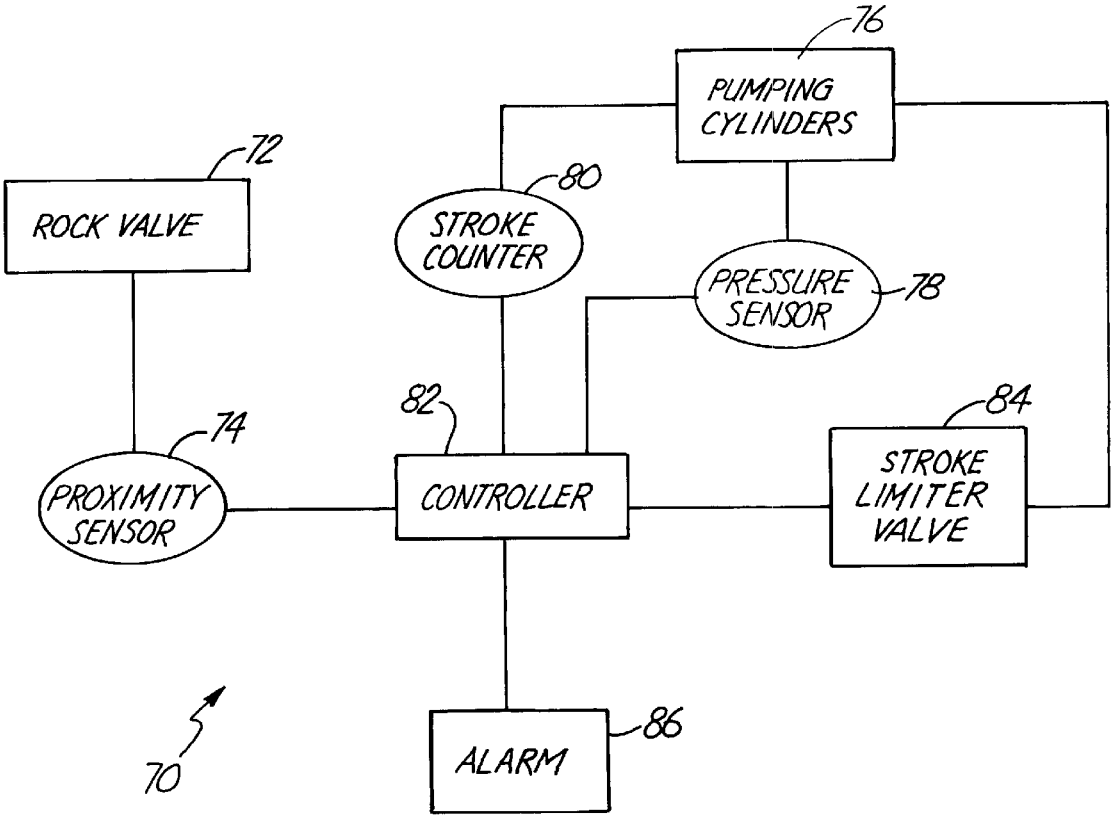
FIG. 4 is a block diagram of a pipeline air pocket detection and control system.

FIG. 4 is a block diagram of one suitable configuration of a pipeline air pocket detection and control system. Illustrated as part of the system 70 is a Rock valve 72, a proximity sensor 74, pumping cylinders 76 of the concrete pump, a pressure sensor 78, a stroke counter 80, a controller 82, a stroke limiter valve 84, and an alarm 86.

The proximity sensor 74 is associated with the Rock valve 72 and senses when the Rock valve 72 changes position. After the start of a pump stroke is detected, the controller 82 collects data from the pressure sensor 78 at selected times during the pump stroke. The pressure sensor 78 monitors the hydraulic pressure of the pump and supplies the pressure data to the controller 82, which can then determine whether an air pocket has entered the boom based on the pressure data. Upon detection of an air pocket, the controller 82 activates the alarm 86.

Also associated with the pumping cylinders is a stroke counter 80. The stroke counter 80 counts the pumping strokes of the pumping cylinders as the pump operates and supplies this data to the controller 82. Once an air pocket is detected, the controller 82 can control the pump based on the data from the stroke counter 80. Using the stroke counter 80, the controller 82 can track the number of strokes as the air pocket moves through the boom. When the stroke counter 80 indicates that the air pocket is about to exit the boom, the controller 82 can slow the pump speed to lessen the impact of the air pocket as it exits at the nozzle. One way to slow the pump speed is to activate the stroke limiter valve 84, which is connected to the pumping cylinders 76. The stroke limiter valve 84 controls the flow of hydraulic fluid to the pumping cylinders and thus can be used to slow the pump speed.

Figure 5:
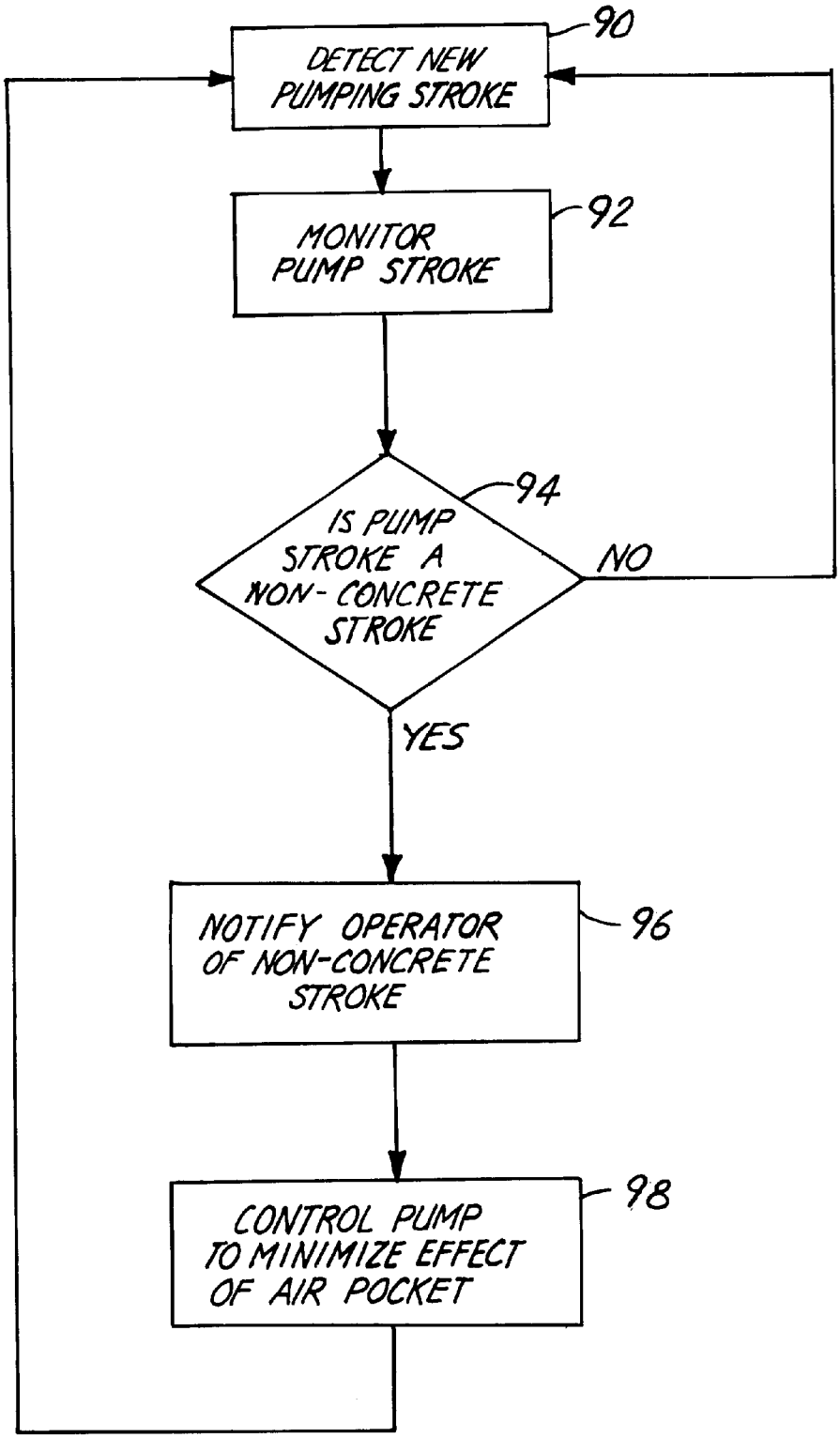
FIG. 5 is a flow diagram illustrating the method of controlling a concrete pump according to the present invention.

FIG. 5 is a flow diagram illustrating one method of controlling a concrete pump according to the present invention. The first step 90 as described above is to determine the start of a new pumping stroke. Once a new stroke begins, the next step 92 is to monitor the pump stroke. Upon monitoring the pump stroke, the third step 94 is to determine whether the pump stroke is a concrete stroke or a non-concrete stroke. A stroke is a "non-concrete" stroke when the stroke contains air with concrete. All other strokes are considered concrete strokes.

One specific method of monitoring the pump stroke to determine whether it is a concrete stroke or a non-concrete stroke is to monitor the hydraulic pressure of the hydraulic drive cylinders during the pumping stroke. For instance, the hydraulic pressure can be measures at two sample times, $T_1$ and $T_2$. $T_1$ and $T_2$ can be set based certain pump parameters, including stroke time and the speed of the pump. In particular, the stroke time of a typical concrete pump can vary from two seconds to forty seconds depending upon the speed at which the pump is operating. There is about one half to one second of instability in the hydraulic pressure during the changeover from one piston to the other (that is when one piston changes from the suction stroke to the pump stroke). Thus, the first sample at $T_1$ can be set to occur at 0.5 seconds after the stroke starts. The second sample $T_2$ can be set to occur at about 0.1 seconds before the stroke ends. $T_1$ and $T_2$ can be adjusted depending upon the relationship between the actual and indicated stroke start.

Next, the pressures collected at $T_1$ and $T_2$ can be analyzed to determine the type of stroke the pump has just completed. Specifically, the pressure collected at $T_1$ can be compared to a low pressure threshold set at, for instance, between 10 bars to 80 bars. The low pressure threshold indicates the low pressure likely to be experienced in a hydraulic cylinder if the material cylinder contains air and the material piston is more easily advanced as that air is being compressed. If the pressure at $T_1$ is below the low pressure threshold, then a second sample collected at $T_2$ can be compared to a pressure rise threshold.

The pressure rise threshold may be set at, for instance 200–600 percent of the low pressure threshold. If the pressure measured at $T_2$ exceeds the pressure rise threshold, this indicates that the pumping cylinder has experienced increased pressure because the air has been completely compressed and the pumping piston is now pumping the concrete. The resulting pressure curve of any non-concrete stone will be similar to the pressure curve 62 illustrated above in FIG. 3. Thus, if the pressure at $T_1$ is lower than the low pressure threshold and the pressure at $T_2$ exceeds the first sample by the pressure rise threshold, the stroke is classified as a non-concrete stroke.

Once the stroke is determined to be a non-concrete stroke, the next step 96 is to notify the operators, such as by activating an alarm. The alarm may be in the form, for instance, of a horn which sounds loud enough to alert all three types of operators, regardless of their position relative to the hopper. The alarm may likewise sound only at the operator in charge of monitoring the fill level of the hopper, or may sound at the nozzle end to warn the nozzle operator of an impending air pocket, or may sound at both places.

In addition to sounding an alarm to alert the operators, in the next step 98, the operation of the concrete pump can be controlled to minimize the effect of the air pocket as it is ejected from the nozzle. One method of doing this is to slow the pump. However, it is not necessary to slow the pump for the entire amount of time it takes the air pocket to move through the several lengths of boom between the hopper and the nozzle. Doing so reduces the efficiency of the pump. Rather, the pump can be slowed after sufficient time has passed to allow the air pocket to move through most of the boom so that the pump is slowed shortly before the air pocket is about to reach the nozzle. Slowing the pump decreases the speed at which the air pocket returns to atmospheric pressure, and thus minimizes the explosive effect of the air pocket.

One method of maintaining efficiency in the pump by controlling the speed of the pump as the air pocket reaches the nozzle is as follows. Because the volume of concrete pumped per stroke remains constant, the travel time (in terms of the number of pump strokes) of one stroke volume of concrete through the boom is constant. This can be calculated or measured, and entered into a controller as "Strokes Until Back Off." A controller associated with the pump can be programmed to maintain a first in first out (FIFO) queue containing a record of the concrete and non-concrete strokes in the boom system.

Each entry into the queue represents a stroke type, either concrete or non-concrete. The normal queue length is the same as the Stroke Until Back Off count, which is the number of strokes it takes for one pump stroke of concrete to be pumped from the hopper to the nozzle. As the type of each stroke is determined, it is added to the input or back of the queue. Each entry in the queue takes a number of strokes equal to the Stroke Until Back Off strokes to travel from the back of the queue to the front. The pump controller removes an entry from the output, or front of the queue, after each stroke. If that removed entry is a non-concrete stroke, the pump begins operating in the back-off mode, which simply means the speed of the pump is slowed. If the entry removed from the queue is a concrete stroke, the pump is restored to its full pump speed.

As described above, the number of Strokes Until Back Off is the number of strokes it takes for one pump stroke of concrete to move from the hopper to the nozzle, which is also an indication of the amount of concrete in the boom. It is difficult to determine the exact amount of concrete in the boom when there is air in the boom. When air enters the boom, the volume of concrete is reduced so that it will take less time for one pump stroke to travel from the hopper to the nozzle. To compensate, it is desirable to set the Strokes Until Back Off value a few strokes less than the boom length (in strokes). This will ensure that the back off mode will start a few strokes before the air pocket reaches the nozzle at the end of the boom. The pump can be operated in the back off mode for more than one pump stroke to further compensate for any non-concrete strokes which may be in the boom system. The duration of time the pump is operated in the back off mode is set by the "Back Off Duration." Thus, whenever a non-concrete entry is removed from the front of the queue, the pump operates in back off mode for a number of strokes equal to the Back Off Duration. The Back Off Duration ensures the pump is slowed long enough to be sure the air pocket has fully exited the boom system.

Below as Table 1 is an illustration of the basic pump control method described above. In the example below, the number of strokes for a volume of concrete to travel from the pump to the nozzle is calculated to be ten, the Stroke Until Back Off is set to eight, and the Back Off Duration is set at two stokes. Thus, if a non-concrete stroke is detected at stroke $S_n$, the pump will go into back off mode at stroke $S_{n+8}$ and will stay in this mode for two strokes. In the table below, a "0" represents a concrete stroke, while a "1" represents a non-concrete stroke.

TABLE 1

| Stroke Count | Queue | Back Off Mode |
|---|---|---|
| $S_n$ | 10000000 | No |
| $S_{n+1}$ | 01000000 | No |
| $S_{n+2}$ | 00100000 | No |
| $S_{n+3}$ | 00010000 | No |
| $S_{n+4}$ | 00001000 | No |
| $S_{n+5}$ | 00000100 | No |
| $S_{n+6}$ | 00000010 | No |
| $S_{n+7}$ | 00000001 | No |
| $S_{n+8}$ | 00000000 | Yes |
| $S_{n+9}$ | 00000000 | Yes |
| $S_{n+10}$ | 00000000 | No |
| $S_{n+11}$ | 00000000 | No |

The volume of a concrete stroke is constant because concrete is nearly incompressible. However, the volume of a non-concrete stroke is not constant. The volume of a non-concrete stroke depends on the volume of air initially pumped into the boom and the amount of compression the air undergoes in the boom. This in turn depends upon the characteristics of the concrete and the pump speed or concrete flow rate. Because the volume of a non-concrete stroke is less than that of a concrete stroke, each non-concrete stroke in the boom increases the number of strokes it will take for a particular volume of material to travel through the boom. When using a queue system to track the movement of an air pocket through the boom, the queue remains a fixed length, i.e. the same as the Stroke Until Back Off. If there are several non-concrete strokes in the system, the pump will effectively go into the back off mode too soon and will likewise resume normal speed too soon, possibly resulting in the pump operating at full speed when the air pocket reaches the nozzle. To compensate for the effect of air compression in the boom, it is possible to alter slightly the volume assumed to be in the boom at a given point.

One method of tracking a potential change in volume of concrete in the boom system resulting from non-concrete strokes is to use an Air Stroke Compression Factor. The Air Stroke Compression F actor is adjustable from 5% to 10% and is the effective stroke volume for each non-concrete stroke in the system. For example, if non-concrete strokes on the average compress to one-quarter of the volume of a concrete stroke, the Air Stroke Compression Factor would be set to 25%. This means that each non-concrete stroke counts as 25% of a concrete stroke. This use of estimation to set the Air Stroke Compression Factor is done because the system cannot make a determination of the exact volume of the non-concrete stroke or the amount of compression in a non-concrete stroke. Thus, the Air Stroke Compression Factor is selected to give the best results under typical conditions and is an estimate.

In addition, the queue can be lengthened depending upon the number of non-concrete strokes in the queue. Because the volume of the boom is fixed, a volume represented by the stroke record in the queue is also fixed. For example, if the normal queue length is ten concrete strokes, the Air Stroke Compression Factor is 25%, and four non-concrete strokes are pumped, the queue should be thirteen entries long: nine strokes of 100% volume (the nine concrete stroke volumes), plus four strokes at 25% volume (one concrete stroke volume).

Further, the fixed volume of the boom means that the volume of concrete ejected at the nozzle on each stroke is the same as the volume pumped into the boom during that stroke. When a non-concrete stroke is pumped into the boom, the volume ejected will not be equal to a full stroke, but will be a fraction of a full stroke approximately equal to the Air Stroke Compression Factor. Entries in the queue, however, can represent only full strokes In other words, when a non-concrete stroke is pumped into an otherwise full boom, only a partial stroke volume of concrete is ejected at the nozzle.

The equivalent operation in the pump control algorithm is adding a non-concrete stroke entry to the end of the queue while a fill concrete stroke is removed from the front of the queue. Since a partial volume has been added but a full volume removed from the queue, the difference can be saved as the Fractional Volume of concrete still in the boom. The Fractional Volume is always between zero and one. The total volume of air and concrete in the boom is constant so that in terms of strokes of concrete, the volume is equal to the number of concrete stroke entries in the queue, plus the number of non-concrete stroke entry times the Air Stroke Compression Factor, plus the Fractional Volume. The computation of the Fractional Volume is part of the queue maintenance performed by the controller.

Shown below as Table 2 is an example illustrating the above principles. In the example, the Stroke Until Back Off is set at five, the Air Stroke Compression Factor is 30%, and the Back Off Duration is two strokes. The given example tracks a double stroke non-concrete bubble, showing the queue growth and restoration.

TABLE 2

| Stroke Count | Queue (1 = non-concrete stroke) | $V_f$ (Fractional Volume) | Back Off Counter |
|---|---|---|---|
| $S_{n-1}$ | 00000 | 0 | 0 |
| $S_n$ | 10000 | 0.7 | 0 |
| $S_{n+1}$ | 110000 | 0.4 | 0 |
| $S_{n+2}$ | 011000 | 0.4 | 0 |
| $S_{n+3}$ | 001100 | 0.4 | 0 |
| $S_{n+4}$ | 000110 | 0.4 | 0 |
| $S_{n+5}$ | 000011 | 0.4 | 0 |
| $S_{n+6}$ | 00000 | 0 | 3 |
| $S_{n+7}$ | 00000 | 0 | 2 |
| $S_{n+8}$ | 00000 | 0 | 1 |
| $S_{n+9}$ | 00000 | 0 | 0 |

It is also possible for the algorithm to recognize certain special conditions under which the concrete pump may normally operate, such as the start of a pump job, the purging of concrete from the boom, and pumping water through the boom to clean it. Upon starting a pump, air is pumped into an empty boom. While air is pumped into an empty boom, the hydraulic pressure remains constant and low throughout the entire pump stroke. Thus, the strokes will be classified as concrete strokes and the controller will not interfere with the pump speed. Next, as concrete is supplied to the hopper and concrete beings to be pumped into an empty boom, the pump's hydraulic pressure will be relatively high. This relatively high pressure also slowly increases throughout the stroke. As such, the strokes will not exhibit a steep enough pressure curve to indicate a non-concrete stroke, but rather will be classified as concrete strokes. Therefore, pump start-up is treated the same as when pumping concrete into a full boom, and the controller will not interfere with the pump speed.

When purging the pump at the end of a pumping job, air is pumped into a full boom. In this situation, all strokes will register as non-concrete strokes. To address such a situation, the controller can be programmed to disable the queue program after a given number of consecutive non-concrete strokes.

Finally, when cleaning the pump, water is pumped into a full boom. The water strokes should look essentially like concrete strokes in that the pressure should remain constant throughout the pump stroke. However, as the water fills the boom and the concrete is expelled, the pressure should gradually fall due to the lower density and viscosity of the water. Despite this, the water pumping strokes will continue to have a uniform pressure across the stroke, and the controller will recognize them as concrete strokes and not interfere with the pump speed.

Though disclosed in terms of a queue theory, there are a variety of methods for determining the number of strokes required before the pump is put into the back off mode. For instance, it may be possible to set a predetermined number of strokes that equal the average number of strokes it will take for a concrete stroke to reach the end of the boom based on the known length of the boom. Thus, rather than compensating for any non-concrete strokes that may affect the volume in the boom, once an air pocket is detected, the pump is allowed to pump for the given number of strokes and then goes into back off mode for a given number of back off strokes. Any loss in pumping efficiency is made up for in ease of programming. In addition, though discussed in terms of the pump going into automatic mode, it is also possible for an operator to manually slow the pump speed based on an intuitive understanding of how long it will take the air pocket to reach the nozzle. Finally, the pump may simply count the number of strokes until the back off mode should start and rather than automatically slowing the pump, may provide a separate indication to the operator so that the operator may manually slow the pump at the appropriate time.

Although the present invention has been described with reference to preferred embodiments, workers skilled in the art will recognize that changes may be made in form and detail without departing from the spirit and scope of the invention.

What is claimed is:

1. A method of controlling operation of a concrete pump, the method comprising:

sensing a non-concrete pumping stroke containing air; and reducing a pumping rate of the concrete pump during at least a portion of time in which an air pocket associated with the non-concrete pumping stroke is pumped through a boom to a nozzle.

2. The method of claim 1 wherein reducing the pumping rate is for a first plurality of pumping strokes.

3. The method of claim 2 wherein reducing the pumping rate begins after a second plurality of pumping strokes occurs following sensing of the non-concrete pumping stroke.

4. The method of claim 1 wherein sensing a non-concrete pumping stroke comprises:

sensing a first hydraulic pressure in the concrete pump after the beginning of a pumping stroke;

sensing a second hydraulic pressure in the concrete pump before the end of the pumping stroke; and comparing the first hydraulic pressure to a low pressure threshold and comparing the second hydraulic pressure to a high pressure threshold.

5. The method of claim 4 and further comprising sensing a beginning of the pumping stroke before sensing the first hydraulic pressure.

6. A method of controlling flow of concrete through a concrete pump as the concrete is pumped from a hopper through a boom to a nozzle, the method comprising;

sensing a non-concrete pumping stroke;

determining a first number of pumping strokes corresponding to the number of pump strokes required for the non-concrete pumping stroke to pass through the boom and reach the nozzle; and reducing a pumping speed of the concrete pump before the first number of pumping strokes has occurred.

7. The method of claim 6 wherein the pumping speed is reduced for a second number of pumping strokes.

8. The method of claim 6 and further comprising notifying a pump operator upon sensing a non-concrete pumping stroke.

9. The method of claim 6 and further comprising sensing a beginning of a pumping stroke before sensing a non-concrete pumping stroke.

10. A method for determining when a pumping stroke in a concrete pump contains air, the method comprising:

sensing the beginning of a pumping stroke;

monitoring a hydraulic pressure associated with the pumping stroke; and determining based on the hydraulic pressure whether the pumping stroke contains air.

11. The method of claim 10 wherein sensing a beginning of a pumping stroke comprises sensing a position of an outlet valve on the concrete pump.

12. The method of claim 10 wherein monitoring the hydraulic pressure comprises:

sensing a first hydraulic pressure after a start of the pumping stroke;

sensing a second hydraulic pressure before an end of the pumping stroke;

comparing the first hydraulic pressure to a low pressure threshold; and comparing the second hydraulic pressure to a pressure rise threshold.

13. A method of controlling the pumping of concrete through a boom, the method comprising:

monitoring a pump stroke of the concrete pump to detect the presence of air in the pump stroke; and sounding an alarm upon detection of air in the pump stroke.

14. The method of claim 13 and further comprising slowing a pumping speed of the concrete pump before the air exits the boom.

15. The method of claim 14 wherein slowing the pumping speed occurs at a time just before the air exits the boom.

16. The method of claim 14 wherein the pumping speed is slowed for an amount of time sufficient to allow the air to exit the boom.

17. A method of detecting air in a concrete pump, the method comprising:

collecting hydraulic pressure data from the concrete pump as the pump is pumping concrete; and comparing the hydraulic pressure data to a pressure curve.

18. The method of claim 17 wherein collecting hydraulic pressure data comprises:

sensing a start of a pumping stroke;

sensing a first pressure after the start of a pumping stroke; and sensing a second pressure before the ending of a pumping stroke.

19. The method of claim 18 wherein comparing the hydraulic pressure data to a pressure curve comprises comparing the first pressure to a first pressure threshold and comparing the second pressure to a second pressure threshold.

20. A method of controlling a concrete pump, the method comprising:

collecting hydraulic pressure data from the pump during a pump stroke;

determining based on the hydraulic pressure data whether the pump stroke is a concrete stroke or a non-concrete stroke containing air; and controlling a speed of the pump in response to the non-concrete stroke.

21. The method of claim 20 wherein controlling the speed of the pump occurs before the non-concrete stroke exits the pump.

22. The method of claim 21 wherein the non-concrete pump stroke is placed in a queue representing the number of strokes the pump must complete to move a concrete stroke from a hopper to a nozzle.

23. The method of claim 22 wherein controlling the speed of the pump occurs when the non-concrete pump stroke reaches the end of the queue.

24. The method of claim 20 wherein controlling the speed of the pump comprises slowing the pump for a plurality of strokes to ensure the non-concrete stroke has exited the pump.

* * * * *